US006629941B1

(12) United States Patent
Ishibashi et al.

(10) Patent No.: US 6,629,941 B1
(45) Date of Patent: Oct. 7, 2003

(54) AIR MASSAGE SYSTEM

(75) Inventors: Shigemitsu Ishibashi, Tokyo (JP); Haruki Nakao, Tokyo (JP)

(73) Assignee: Nitto Kohki Co., Ltd. (JP)

( * ) Notice: Subject to any disclaimer, the term of this patent is extended or adjusted under 35 U.S.C. 154(b) by 0 days.

(21) Appl. No.: 09/471,714

(22) Filed: Dec. 23, 1999

(30) Foreign Application Priority Data

Dec. 28, 1998 (JP) ..... 10-374047

(51) Int. Cl.[7] ..... A61H 23/62
(52) U.S. Cl. ..... 601/152
(58) Field of Search ..... 601/41–44, 149–152

(56) References Cited

U.S. PATENT DOCUMENTS

| | | | | |
|---|---|---|---|---|
| 3,826,249 A | | 7/1974 | Lee et al. | |
| 4,029,087 A | | 6/1977 | Dye et al. | |
| 4,374,518 A | | 2/1983 | Villanueva | |
| 4,481,937 A | * | 11/1984 | Arkans | 601/150 |
| 4,981,131 A | * | 1/1991 | Hazard | 128/38 |
| 5,261,459 A | | 11/1993 | Atkinson et al. | |
| 5,876,359 A | * | 3/1999 | Bock et al. | 601/150 |

FOREIGN PATENT DOCUMENTS

| | | | | |
|---|---|---|---|---|
| EP | 0 916 332 A1 | | 11/1998 | |
| EP | 11019145 | | 1/1999 | |
| GB | 2 285 749 A | | 1/1994 | |
| JP | 51-41794 | | 11/1976 | |
| JP | 044875 | | 7/1982 | |
| JP | 7-171185 | * | 7/1995 | A61H/7/00 |
| JP | 347035 | | 12/1998 | |
| JP | 347707 | | 12/1998 | |
| JP | 11-19145 | | 1/1999 | |

OTHER PUBLICATIONS

Office Action in Korean counterpart application and English translation.
Translation of opposition (10 pages).
Opposition (11 pages).

* cited by examiner

*Primary Examiner*—Danton D. DeMille
(74) *Attorney, Agent, or Firm*—Harness, Dickey & Pierce, P.L.C.

(57) ABSTRACT

A compact air massage system is provided which enables the user to receive a comfortable feeling of massage on each part of the limbs. The system includes massage bodies having a plurality of air-tight chambers, a compressed air supply source supplying compressed air to the massage body, and a compressed air distribution apparatus arranged between the compressed air supply source and the massage body and having a plurality of switching valves each allowing the respective air-tight chambers to communicate with one of the compressed air supply source and an outer atmosphere. The system further includes a controller controlling the respective switching valves to allow the respective chambers to be expanded or contracted and check valves each arranged between the compressed air supply source and the switching valve and openable from the compressed air supply source toward the direction of the switching valve, by which it is possible to individually adjust pressure in the respective chambers.

8 Claims, 4 Drawing Sheets

AIR MASSAGE SYSTEM

BACKGROUND OF THE INVENTION

The present invention relates to an air massage system and, in particular, to an air massage system for massaging a human body by selectively supplying compressed air to a plurality of air-tight chambers provided at massage bodies and selectively discharging the compressed air from these chambers.

An air massage apparatus of a type set out below is conventionally known which, in order to restore, maintain, improve the human health, performs a continuous massage by sequentially supplying and discharging compressed air to and from a plurality of air-tight chambers of massage bodies worn around the upper or lower limbs of the user.

Normally, such massage apparatuses include a compressed air distribution apparatus for distributing compressed air from the compressed air supply source to respective air-tight chambers and discharging it from the chambers. For example, the compressed air distribution apparatus is such that respective air-tight chambers are repeatedly expanded and contracted by distributively supplying and discharging the compressed air with the use of ordinary electromagnetic valves.

The assignee of the present invention has proposed a distribution apparatus in JPN PAT APPLN NO. 9-188967 (filed on Jul. 1st, 1997 and published on Jan. 26th, 1999) in which distribution valve is provided at a supply passageway (header) of a compressed air supply source to correspond to respective air-tight chambers of the massage body. The distribution valve is provided with three-way valves each having a supply port, distribution port and discharge port and being adapted to be opened and closed by a spherical valve body operated by a solenoid section.

The air massage apparatus, however, requires to use an electromagnetic valve of a small pressure loss which is suited to a pump of a low pressure and high flow rate. In such air massage apparatus, such ordinary electromagnetic valve is larger in size, higher in cost and lower in mass-productivity. Further, this type of electromagnetic valve can adjust a cycle of suction into the air-tight chambers of the massage body, but it cannot adjust the rate of air flow into the respective chamber (see JPN PAT KOKOKU PUBLICATION NO. 51-41794).

The distribution valve as described in the above-mentioned JPN PAT APPLN NO. 9-188967 can be manufactured at low costs and can supply/discharge a large quantity of compressed air. By doing so it is possible to switch the air-tight chambers selectively or in a predetermined cycle or to effectively supply and discharge air to and from the chambers. However, it is not possible to adjust pressure in the respective chamber.

In particular, the wearer receives a different feeling when being massaged on the upper or lower limbs. In the case where the pressure in the respective chambers is the same, it gives pain to the thigh but it is not satisfactory to the top of the foot. The inventor of the present application enables the user to receive a well-balanced body feeling by increasing pressure in the respective chambers toward his or her foot's top or hand's tip.

BRIEF SUMMARY OF THE INVENTION

The present invention has been achieved based on the above circumstances and it is the object of the present invention to provide an air massage system which is simple in structure and inexpensive and give the user a comfortable message feeling.

According to the present invention there is provided an air massage system comprising a massage body having a plurality of air-tight chambers, a compressed air supply source for supplying compressed air to the massage body, a compressed air distribution apparatus arranged between the compressed air supply source and the massage body and having a plurality of switching valves allowing the respective chamber to communicate with one of the compressed air supply source and an outer atmosphere, a controller for controlling the respective switching valve to expand or contract the respective chambers and check valves respectively arranged between the compressed air supply source and the respective switching valve and being open in a direction from the compressed air supply source toward a direction of the switching valve, the chambers being individually controllable in pressure.

By doing so, the user receives a mutually different pressing force at each body part contacting with the respective chamber without simply receiving a uniform pressing force at the respective body part. And the user can receive a well-balanced feeling corresponding to the respective body parts. This provides added massaging effect to the user.

It is preferable that the compressed air supply source have a tank holding compressed air therein and the controller have a sensor detecting a variation of pressure in the tank and that, by doing so, an output of the compressed air supply source be controlled in accordance with a magnitude corresponding to the pressure in the tank. In this case, there occurs no greater variation in an output of the compressed air supply source and the user never receives any unpleasant feeling resulting from a sudden variation of sound.

It is also preferable that the controller sequentially supply compressed air to each air-tight chamber in a given supply sequence while adjusting it to an equal or lower level.

It may be possible to have a shut-off valve interruptible between the tank and the respective check valve and control this shut-off valve by a controller. In this case, it is possible to control the pressure in the respective chamber to any given level.

It is desirable that the controller store a plurality of control patterns each operating respective switching valves so that the user can select any one of them.

It is preferable that the switching valve include a valve box having a supply port communicating with the compressed air supply source, a distribution port communicating with the chamber and an discharge port communicating with an outer atmosphere, a valve body movably received in the valve box and allowing the distribution port to communicate with one of both the supply port and the discharge port, a solenoid controlled by the controller, and a movable member coupled to the valve body and driven by the solenoid. In this case, the switching valve is formed as a very compact and simpler structure.

The valve box has a substantially cylindrical configuration and has a valve seat with the supply port opened on a one-end side of an axial direction thereof and can hold the check valve on an other-end side.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

With reference to the accompanying drawing, an explanation will be made below about preferred embodiments of the present invention.

Figure 1:
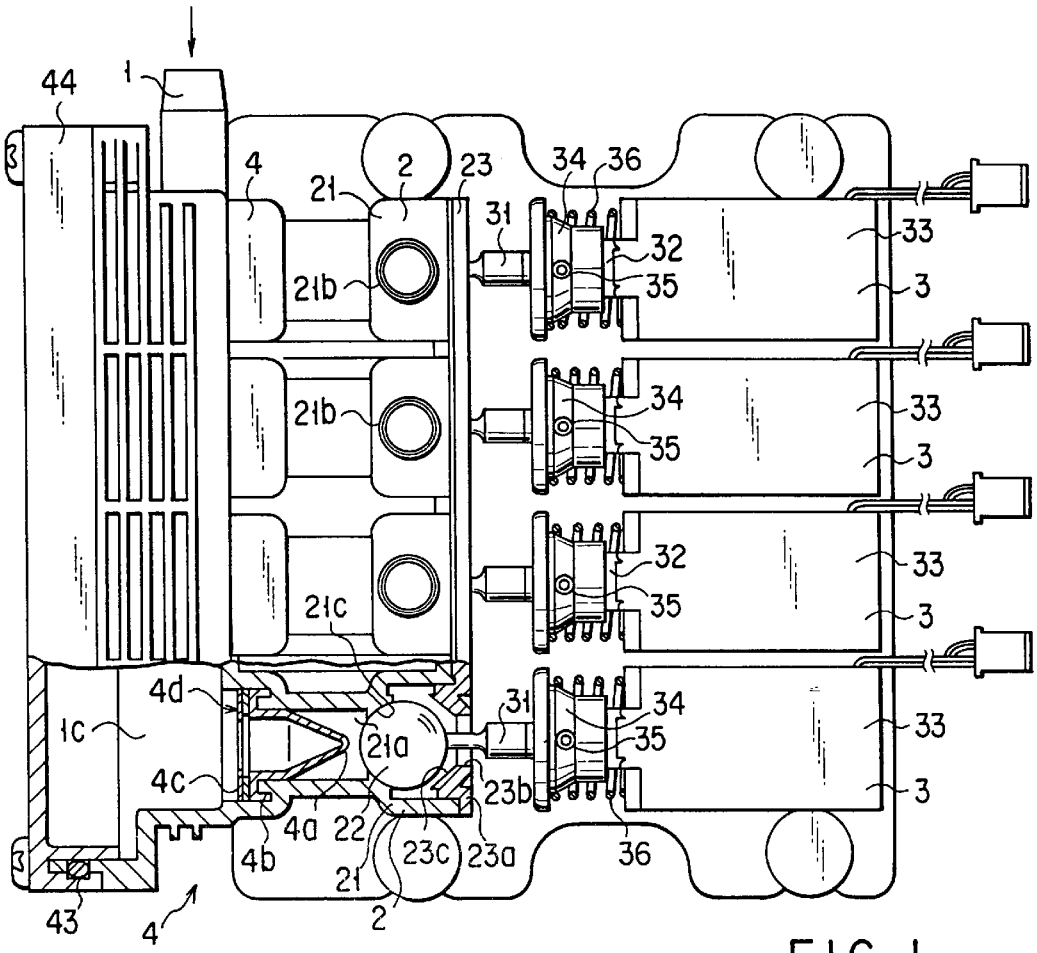
FIG. 1 is a plan view, partly cut away, showing a compressed air distribution apparatus used in an air massage system according to an embodiment of the present invention.
Figure 2:
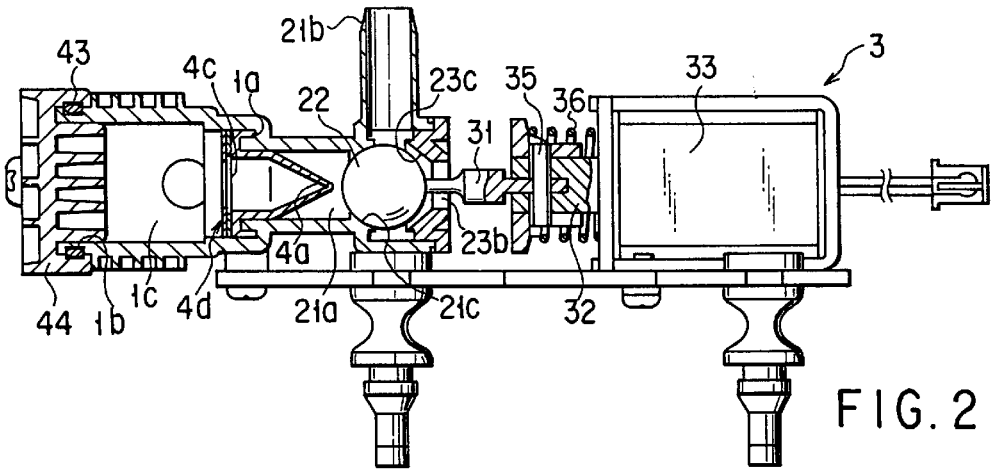
FIG. 2 is a cross-sectional view showing a switching valve of the compressed air distribution apparatus shown in FIG. 1.
Figure 3:
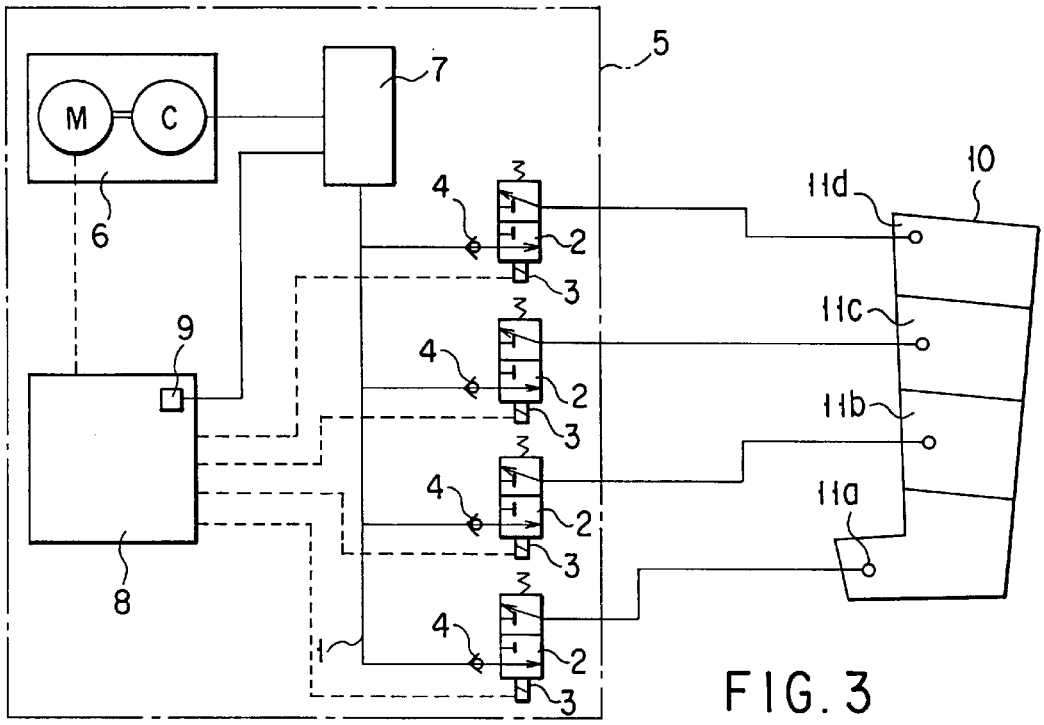
FIG. 3 is a circuit diagram schematically showing a pneumatic circuit and electric circuit in the air massage system according to the embodiment of the present invention.

FIGS. 1 to 3 show a compressed air distribution apparatus used for an air massage system adapted to supply compressed air to air chambers of a massage body as will be set out below and discharge the compressed air from the air-tight chambers. This compressed air distribution apparatus comprises a header 1 connected to a compressed air supply source 6, such as an air compressor C, a plurality of switching valves 2 arranged along the header 1 in a parallel way, electromagnetic drive sections 3 each driving a spherical valve body 22 provided in the respective switching valve 2, and check valves 4 each provided between the header 1 and a supply port of the switching valve 2. It is to be noted that the number of the switching valves 2 and that of the checking valves 4 are decided in accordance with the number of compressed air supply passageways and, in the illustrated embodiment, the switching valves 2 and check valves 4 are, respectively, four in number.

The respective switching valve 2 comprises a substantially cylindrical valve box 21 integrally formed with the header 1 made of a resin, a valve body 22 spherically formed from an elastic material such as silicone rubber, chloroprene rubber, ethylenepropylene rubber or the like, and held at one end side of the valve box 21, and a plate-like cover member 23. The plate-like cover member is joined to the four valve boxes 21 by welding or bonding.

In the valve box 21, a distribution port 21*b* is formed to properly communicate with the air-tight chamber 11 provided in the massage body 10 and a conical or spherical valve seat 21*c* is formed at a circumferential edge portion of a supply port 21*a* to allow the valve body 22 to abut thereagainst. On the cover member 23 mounted at the openings opposing to the supply ports 21*a*, valve seats 23*a* project at intervals equal to the openings of those parallel valve boxes 21 and in number equal to the valve box 21. A discharge port 23*b* is formed in the respective valve seat 23*a* and a conical or spherical valve seat 23*c* is formed in the circumferential edge portion of the discharge port 23*b*. Further, one end of an operation shaft 31 of an electromagnetic drive section 3 is previously mounted on the valve body 22. The valve body 22 is arranged within the valve box 21 and the cover member 23 is provided at the openings of the valve boxes 21. The other end portion of the operation shaft 31 is projected through the discharge port 23*b* in the cover member 23 and coupled to the electromagnetic drive section 3. In this connection it is to be noted that only the outer peripheral portion of the valve body 22 may be made of an elastic material.

Further, on the other-end side of the valve box 21, the check valve 4 is provided to allow a flow of a fluid from the header 1 toward the supply port 21*a* and to prevent a reverse flow.

The electromagnetic drive section 3 comprises the operation shaft 31 mounted on the valve body 22, a movable section 32 coupled to the end of the operation shaft 31 projected through the discharge port 23*b* of the respective switching valve 2, an electromagnet casing 33 containing the movable section 32 and coil, a flange section 34 mounted on the distal end of the movable section 32, a fixing pin 35 connecting both of the operation shaft 31 and flange section 34 to the distal end portion of the movable section 32, and a spring 36 interposed between the flange section 34 and the electromagnet casing 33.

When the coil of the electromagnetic drive section 3 is not energized, the movable section 32 is moved, as shown, toward the switching valve 2 side under an urging force of the spring 36, the valve body 22 which is mounted on the distal end of the operation shaft 31 coupled to the movable section 32 abuts the valve seat 21*c* at the supply port 21*a* to block the supply port 21*a* and allow communication between the distribution port 21*b* and the discharge port 23*b*. Where, on the other hand, the coil of the electromagnetic drive section 3 is energized, an electromagnetic force is generated, thus retracting the movable section 32 into the electromagnet casing 33 against the urging force of the spring 36. By doing so, the valve body 22 mounted on the distal end of the operation shaft 31 coupled to the movable section 32 is moved away from the valve seat 21*c* of the supply port 21*a* into abutting engagement with the valve seat 23*c* of the discharge port 23*b* to block the discharge port 23*b* and allow communication between the supply port 21*a* and the distribution port 21*b*.

The check valve 4 is made of an elastic material and has a beak-like configuration, on one end, with an outlet port 4*a* at its distal end and a cylindrical configuration, on the other end, with an annular projection 4*b* axially projected at its outer periphery. The check valve 4 is inserted through an opening 1*b* of the header 1 and the projection 4*b* is fitted into an annular groove la provided at a circumfencial periphery of the supply port 21*a* communicating with the header 1 integrally extending from the valve box 21. Then the check valve 4 is secured by a retaining ring 4*a* with a washer 4*c* interposed therebetween. The respective opening 1*b* is closed with an integrally formed common cap 44 with a sealing member 43 being interposed between the cap 44 and the outer periphery of the header 1 near the opening 1*b*.

The compressed air from the compressed air supply source 6 is supplied past the outlet port 4*a* of the check valve 4 into the supply port 21*a* and past the opened distribution port 21*b* of the switching valve 2 into the air chambers 11 of the massage body 10. During the supply period, the compressed air is never flowed back into a header chamber 1*c* as the check valve 4 prevents reverse flow.

As shown in FIG. 3, the above-mentioned compressed air distribution apparatus is contained in a body 5 of the massaging apparatus along with a control section 8 which is a controller comprised of the compressed air supply source 6, a tank 7 and a pressure sensor 9. The tank 7 storing the compressed air is connected to the supply line connecting the compressed air supply source 6 and the header 1. The distribution port 21*b* of the respective switching valve 2 is connected to a compressed air access port in the body 5. The air discharged from the discharge port 23*b* of the respective switching valve 2, after entering into the body 5, is discharged from a vent hole (not shown) provided at the body 5. The control section 8 is electrically connected to the motor M of the compressed air supply source 6 and the electromagnetic drive section 3 as indicated by a broken line to supply a control signal. Reference numerals 10 shows the massage body having a plurality of air-tight chambers 11.

Figure 4:
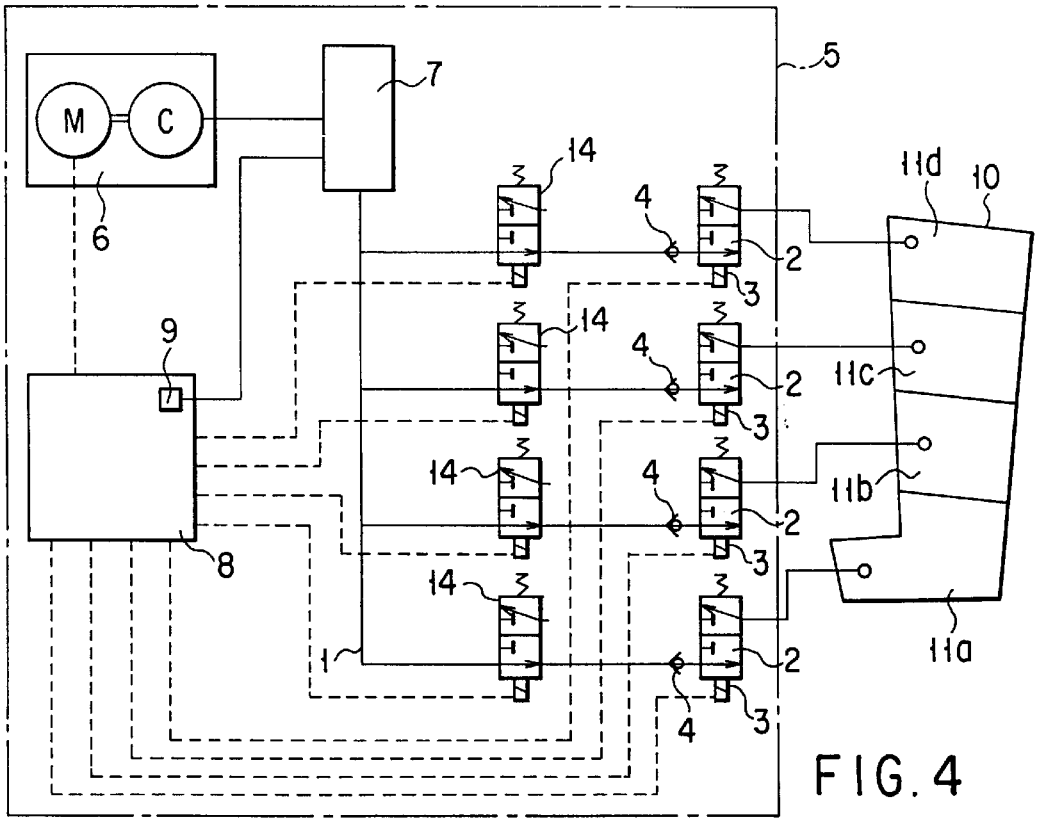
FIG. 4 is a circuit diagram schematically showing another embodiment of the present invention.

FIG. 4 is a circuit diagram schematically showing an another embodiment of the pressure control system for the air massage apparatus of the present invention. In this embodiment, a shut-off valve 14 is provided between the header 1 and the switching valve 2 so as to be electromagnetically controlled. And the check valve 4 is provided between the shut-off valve 14 and the switching valve 2.

By providing the shut-off valve 14 it is possible to selectively control air-tight chambers 11*a* to 11*d* of a massage body 10 with the use of a control section 8.

Figure 9:
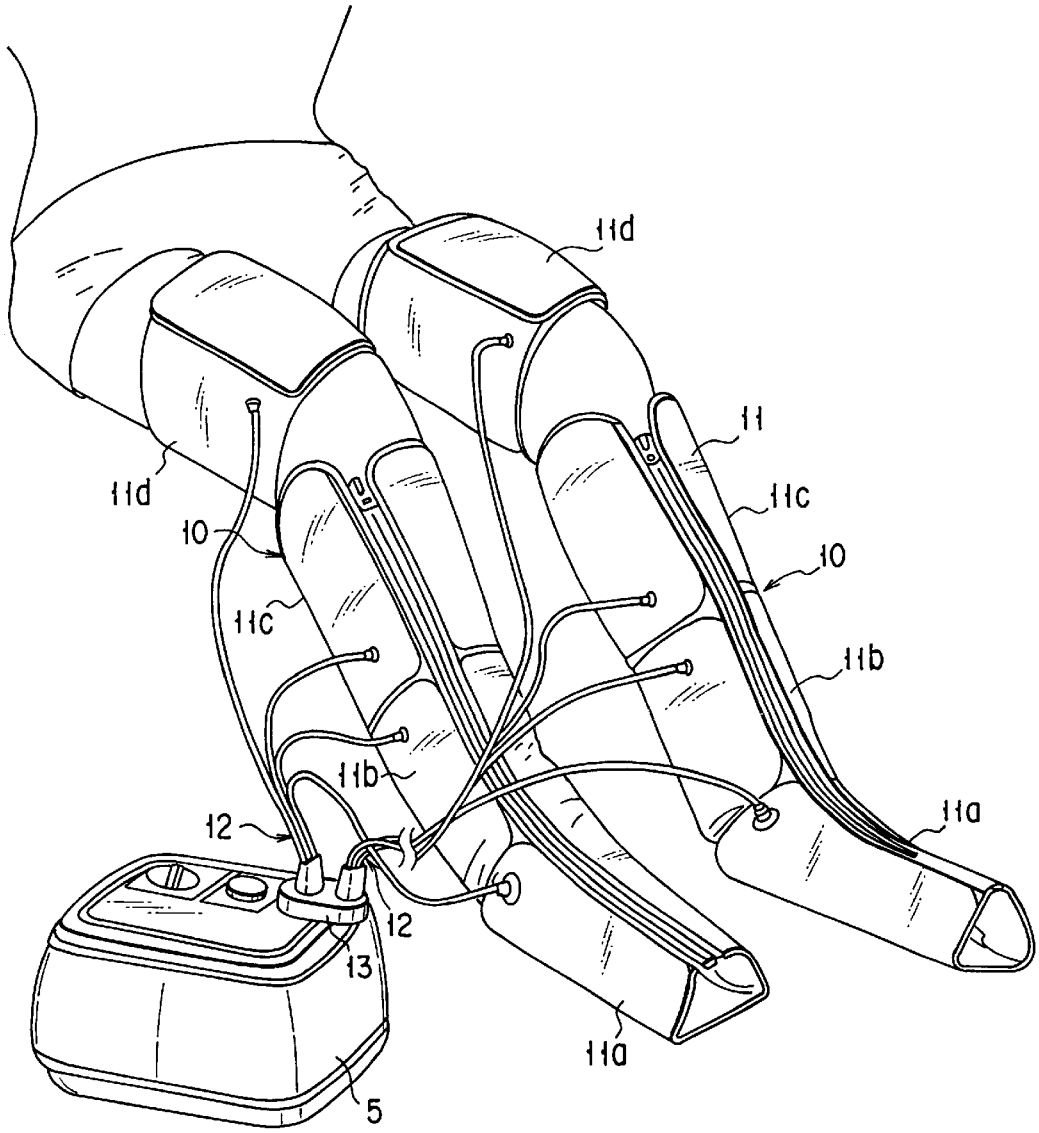
FIG. 9 is an explanatory view showing a whole structure of the air massage system of the present invention.

The function of the pressure control system for air massage according to the present invention will be explained below on the basis of one embodiment of the air pressure type massage apparatus as shown in FIG. 9.

The massage body 10 is of such a type that the user wears it around the upper limbs or lower limbs and it press-massage these limbs from the hand tips toward the shoulders or from the foot tops toward the thighs in a repeated expand/contract way. As shown in FIG. 9 for example, the user wears it either around one or both of lower limbs.

The air pressure type massage apparatus is of such a type as to connect the "bundled" side end of air hoses 12, 12 to the above-mentioned massage apparatus body 5 through an adapter 13 for allowing communication to be made between the distribution ports 21*b* of the respective switching valves 2 and predetermined air-tight chambers 11, 11 and to connect the "separated" side end of the air hoses 12, 12 to predetermined air-tight chambers 11, 11 of the respective massage bodies 10. It is to be noted that, in the case of massaging one leg, it is only necessary to connect the "bundled" side end of the air hoses directly to the massage apparatus body 5.

The massage is started by fitting the massage bodies 10, 10 around both the legs of the user and, after turning on the power supply of the massage apparatus body 5, turning on a switch on the massage apparatus body 5.

When the massage is so started, the compressed air supply source 6 is operated to supply compressed air and the control section 8 starts an ON/OFF operation of the electromagnetic drive section 3. The control section 8 performs the operations of the respective electromagnetic drive sections 3 in an ON/OFF fashion in accordance with a previously stored control pattern.

The ON/OFF control pattern of the electromagnetic drive section 3 is listed below, but the present invention is not limited thereto and it is preferable to store various patterns as the user likes.

Figure 5:
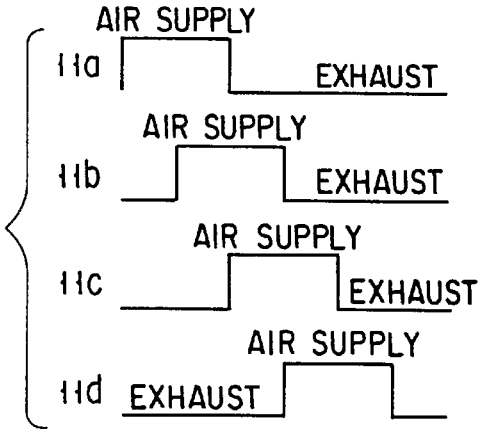
FIG. 5 is an explanatory view showing a compressed air supply pattern.

When an explanation is made below about the pattern shown in FIG. 5 for example, a relation of an internal pressure set in the respective air-tight chambers 11*a*, 11*b*, 11*c*, 11*d* becomes 11*a*≧11*b*≧11*c*≧11*d*.

At a time of massaging, an electromagnetic drive section 3 operating the valve body 22 of the switching valve 2 communicating with the air-tight chamber 11*a* corresponding to the foot top of the user is turned ON and a flow of the compressed air into the air-tight chamber 11*a* is started. When the pressure in the air-tight chamber 11*a* reaches a predetermined level, the supply of the compressed air from the compressed air supply source 6 is adjusted so as to retain the pressure in the air-tight chamber 11*a* below a predetermined level. The pressure adjustment of the compressed air is performed by varying a supply voltage to the compressed air supply source 6 by the control section 8 and adjusting an amount of supply of the compressed air to the massage body 10.

The pressure in the air-tight chamber 11*a* is maintained constant because a reverse flow from the supply port 21*a* into the header chamber 1*c* is prevented by the check valve 4 provided in a passageway through which the compressed air flows and because the compressed air in the air-tight chamber 11*a*, supplied through the valve body 22 of the switching valve 2 opened by the turning ON of the electromagnetic drive section 3 retains the pressure.

Then the switching valve 2 of the air-tight chamber 11*b* is opened to start a supply of air into the chamber 11*b* as in the case of the air-tight chamber 11*a*. Since the pressure in the air-tight chamber 11*a* is set to be higher than the pressure in the air-tight chamber 11*b*, no extra compressed air never flows into the air-tight chamber 11*a* and hence there is no rise in the pressure in the air-tight chamber 11*a*.

Further, since, in the air-tight chamber 11*b*, a back flow of the compressed air into the header chamber 1*c* of the header 1 is prevented by the check valve 4, the air-tight chamber 11*b* is maintained at a set pressure level lower than, or equal to, that of the air-tight chamber 11*a*. Then, the electromagnetic drive section of the air-tight chamber 11*a* goes OFF and the air in the air-tight chamber 11*a* is discharged through the discharge port 23*b* of the switching valve 2.

Air flows into the air-tight chamber unit 11*c* and then into the air-tight chamber 11*d*, in the same way as into the air-tight chamber units 11*a* and 11*b*. Upon lapse of a prescribed time, the electromagnetic drive section 3 associated with the chamber unit 11*c* is turned off. Similarly, upon lapse of a predetermined time, the electromagnetic drive section 3 associated with the chamber unit 11*d* is turned off.

The electromagnetic drive sections 3 are repeatedly turned on and off in the order described above, until a predetermined time elapses from the time the drive section 3 associated with the first air-tight chamber unit 11*a* is turned on for the first time. The pressures in the air-tight chamber units 11*a* to 11*d* are thereby sequentially changed. Hence, the air massage apparatus massages the user, from the toes to the thighs.

Since, with respect to the voltage control of the compressed air supply source 6, a different internal pressure is set in each air-tight chamber 11, the control of the voltage by the control section 8 is done as will be set out below so as to maintain constant the air pressure generated from the compressed air supply source 6 when compressed air is flowed into the air chamber.

Figure 7:
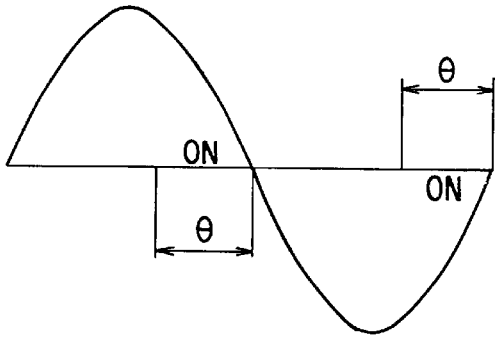
FIG. 7 is an explanatory view showing the controlling of a pressure adjusting mechanism.

FIG. 7 is an explanatory view showing the control done by the control section 8 used in the present invention. The control of the compressed air supply source 6 in accordance with the present invention is done by the control section 8. The control section 8 performs the speed control of the drive motor M of the compressor C by a phase control method in a manner shown.

In FIG. 7, θ shows a conduction angle. During the operation of the massage apparatus body 5 except in an discharge period during which the compressed air is discharged from the massage apparatus body 10 through the opening of the discharge port 23*b*, control is done, by the control of this conduction angle θ, so that a sensed pressure by a pressure sensor 9 is maintained to a desired given pressure level.

Upon the control of the conduction angle θ, control is made as set out below so as to suppress any sudden variation of noise (pump noise) produced from the compressed air supply source 6 with a variation of an internal pressure in the respective air-tight chamber 11.

Figure 8:
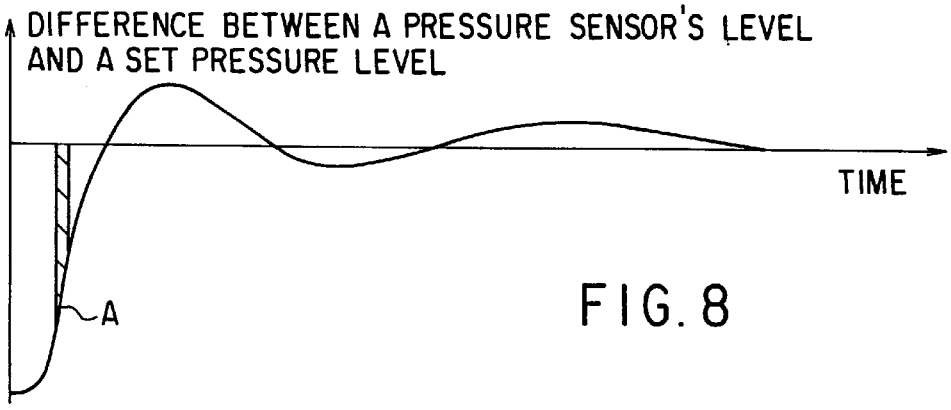
FIG. 8 is an explanatory view showing a pressure difference between a pressure sensor's level and a set pressure level.

FIG. 8 shows a difference between a set pressure value and a pressure value measured by the pressure sensor 9 provided at the control section 8. A difference between the measured pressure and the set pressure (hatched area A) is integrated along time. When the integrated value becomes, for example, about 0.146 ($kgf/cm^2 \cdot sec$), the conduction angle θ is varied.

When the pressure value measured by the pressure sensor 9 greatly deviates from the set value, it is quickly close changed to the set value by increasing a ratio of varying the conduction angle θ in proportion to the difference between the measured pressure and the set pressure.

It is preferred that the proportion coefficient at the time of varying the conduction angle θ be, for example, about 0.1769 ($deg/(gf/cm^2)$) in order to raise and lower, for example, the pumping power. The voltage of the compressed air supply source 6 is therefore varied gradually. As a result, the pressure of the air supplied from the source 6 changes little by little. Hence, the noise of the air being supplied from the source 6 makes does not change so much as to annoy the user of the air massage apparatus.

Figure 6:
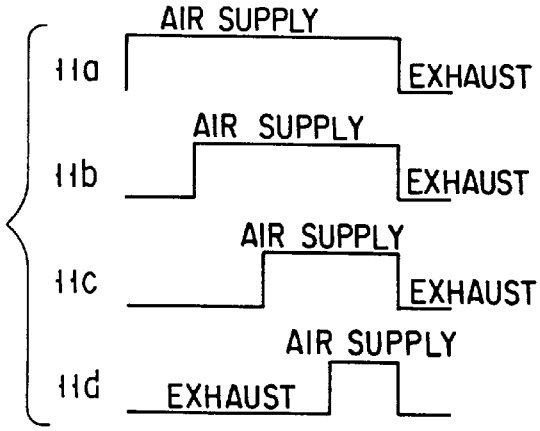
FIG. 6 is an explanatory view showing another compressed air supply pattern.

The electromagnetic drive sections 3 may be repeatedly turned on and off in such a different manner as is illustrated in FIG. 6. More precisely, the sections 3 for driving, respectively, the valve bodies of the switching valves 2 communicating with the air-tight chamber units 11*a* to 11*d*, are sequentially turned on in the order they are mentioned. Each magnetic drive section 3 is stopped upon lapse of a prescribed time from the time it was turned on. The drive sections 3 are repeatedly turned on and off, until a predetermined time elapses from the time the drive section 3 associated with the first air-tight chamber unit 11*a* is turned on for the first time. The pressures in the air-tight chamber units 11*a* to 11*d* are thereby sequentially changed. As a result, the air massage apparatus repeatedly applies a pressure to the user, from the toes to the thighs, and stops applying the pressure at the toes and thighs and the intervening parts at the same time.

Or a massage pattern is such that, until a predetermined time (not shown) is passed, all the electromagnetic drive sections 3 are simultaneously turned ON and OFF and each part of the user is wholly massaged repeatedly at each given interval in a press-applied/released fashion.

When the control section 8 turns on the electromagnetic drive section 3, a solenoid coil in the electromagnet casing 33 is energized, inducing an electromagnetic force to retract a movable section 32 into the electromagnetic casing 33 against an urging force of a spring 36. The valve body 22 connected through the operation shaft 31 to the movable section 32 is moved away from the valve seat 21*c* of the supply port 21*a* and abuts against the valve seat 23*c* of the discharge port 23*b*. Thereby the discharge port 23*b* is blocked, and the supply port 21*a* and the distribution port 21*b* are communicated with each other. The compressed air supplied from the compressed air supply source 6 enters from the outlet port 4*a* of the check valve 4 connected to the header 1 into the supply port 21*a*. And it flows from the supply port 21*a* into the distribution port 21*b* communicating with the supply port 21*a* and it further flows from the distribution port 21*b* past the air hoses 12, 12 and adapter 13 into the predetermined air-tight chambers 11, 11 of the massage bodies 10, 10, thus expanding the associated chambers 11, 11. At this time, the control section 8 connected to the compressed air supply source 6 allows a portion of the compressed air to be discharged to an outside so as to prevent any excessive rise of pressure in the chambers 11*a*, 11*b*, . . . .

When the control section 8 turns off the electromagnetic drive section 3, a current through the coil is stopped, and the movable section 32 is moved toward the switching valve 2 side under an elastic force of a spring. And the valve body 22 mounted on the distal end of the operation shaft 31 coupled to the movable section 32 abuts against the valve seat 21*c* of the supply port 21*a* to block the supply port 21*a* and hence a supply of the compressed air from the supply port 21*a* into the switching valve 2 and, at this time, communication is established between the distribution port 21*b* and the discharge port 23*b* to discharge the compressed air in the predetermined air-tight chamber 11 connected to the distribution port 21*b* through the air hoses 12, 12 and adapter 13 from the respective discharge port 23*b* and allow the corresponding chamber 11 to be contracted.

As set out above, after the chambers 11 are expanded and contracted during the set time period with the electromagnetic drive sections 3 rendered ON and OFF, the compressed air supply source 6 is stopped and all the electromagnetic drive sections 3 are turned OFF to cause all the chambers 11 to be contracted, thus finishing a massage action.

In the alternate embodiment shown in FIG. 4, the switching valves 2 and shut-off valves 14 are connected to the control section 8 by the electric circuit and, since these are separately controlled by the control section 8, the air-tight chambers 11*a*, 11*b*, 11*c* and 11*d* are further controlled, by adjusting the shut-off valves 14 individually, so that it is possible to arbitrarily adjust individual pressure in each chamber.

The operation shaft 31 supported on the distal end portion of the movable section 32 is swingable about a fixed pin 35 and somewhat movable in an up/down direction. Even if, therefore, the moving locus of the center of the valve body 22 is not aligned with the centers of the valve seats 21*c* and 23*c* of the supply port 21*a* and discharge port 23*b*, the center of the valve body 22 and centers of the valve seats 21*c* and 23*c* are automatically adjusted and a positive seal is assured there. Further, the valve body 22 is made of an elastic material and ensures a better sealability upon being abutted against the valve seats 21*c*, 23*c*, so that it is possible to prevent the leaking of the compressed air.

Additional advantages and modifications will readily occur to those skilled in the art. Therefore, the invention in its broader aspects is not limited to the specific details and representative embodiments shown and described herein.

Accordingly, various modifications may be made without departing from the spirit or scope of the general inventive concept as defined by the appended claims and their equivalents.

What is claimed is:

1. An air massage system comprising:

a massage body having a plurality of air-tight chambers;

a compressed air supply source for supplying compressed air to the massage body;

a compressed air distribution apparatus arranged between the compressed air supply source and the massage body and having a plurality of switching valves communicating the respective air-tight chamber with one of the compressed air supply source and an outer atmosphere;

a controller for controlling the respective switching valve to expand or contract the respective chamber;

check valves each arranged between the compressed air supply source and the switching valves, the check valves being open in a direction from the compressed air supply source toward each of the switching valves; and a plurality of valve boxes located within the distribution apparatus, each valve box being associated with one of the plurality of air-tight chambers, each valve box housing a switching valve body and a check valve in nearly adjacent relationship;

wherein each of the check valves prevent backflow of air in a direction from the air-tight chambers communicating with the respective switching valves toward the compressed air supply source, thereby allowing the air pressures of each of the air-tight chambers to be individually controllable and different from the air pressures of the other air-tight chambers.

2. An air massage system according to claim 1, wherein the compressed air supply source has a tank for retaining the compressed air, and the controller has a sensor for detecting a variation of the pressure in the tank and controls an output of the compressed air supply source in accordance with a magnitude of the pressure variation in the tank.

3. An air massage system according to claim 1, wherein the controller supplies the compressed air to the respective air-tight chambers in an air supply sequence while sequentially adjusting a pressure level equal to, or lower than, that of the compressed air.

4. Air an massage system according to claim 1, further comprising a shut-off valve interruptible between a tank and the check valve and adapted to be controlled by the controller.

5. An air massage system according to claim 1, wherein the controller stores a plurality of control patterns each operating the corresponding switching valves, any one of these control patterns being selectable from the user.

6. An air massage system according to claim 1, wherein the valve box has a supply port communicating with the compressed air supply source, a distribution port communicating with the air-tight chambers and a discharge port communicating with an outer atmosphere; the valve body movably received in the valve box and allowing the distribution port to communicate with one of the supply port and discharge port; the switching valve having both a solenoid controlled by the controller and a movable member coupled to the valve body and driven by the solenoid.

7. An air massage system according to claim 6, wherein the valve box has a substantially cylindrical configuration and has a valve seat with the supply port opened on a one-end side of an axial direction thereof and holds the check valve on an other-end side thereof.

8. An air massage system comprising:

a massage body having a plurality of air-tight chambers;

a compressed air supply source for supplying compressed air to the massage body;

a compressed air distribution apparatus arranged between the compressed air supply source and the massage body and having a plurality of switching valves communicating the respective air-tight chamber with one of the compressed air supply source and an outer atmosphere;

a controller for controlling the respective switching valve to expand or contract the respective chamber;

check valves each arranged between the compressed air supply source and the switching valves, the check valves being open in a direction from the compressed air supply source toward each of the switching valves;

wherein each of the check valves prevent backflow of air in a direction from the air-tight chambers communicating with the respective switching valves toward the compressed air supply source, thereby allowing the air pressures of each of the air-tight chambers to be individually controllable and different from the air pressures of the other air-tight chambers;

a valve box associated with each of the switching valves, the valve box including a supply port communicating with the compressed air supply source, a distribution port communicating with the air-tight chambers, and a discharge port communicating with an outer atmosphere; and a switching valve body movably received in the valve box so as to provide communication between the distribution port and one of the supply ports and discharge ports, the switching valve body and the check valve both located in the valve box in close proximity to each other.

* * * * *